United States Patent [19]

Riemersma

[11] Patent Number: 4,610,085

[45] Date of Patent: Sep. 9, 1986

[54] HAIR TRIMMER

[75] Inventor: Pieter Riemersma, Drachten, Netherlands

[73] Assignee: U.S. Philips Corporation, New York, N.Y.

[21] Appl. No.: 685,576

[22] Filed: Dec. 24, 1984

[30] Foreign Application Priority Data

Jan. 5, 1984 [NL] Netherlands ..... 8400037

[51] Int. Cl.[4] ..... B26B 19/06

[52] U.S. Cl. ..... 30/90; 30/34.1

[58] Field of Search ..... 30/34.1, 90, 221, 222

[56] References Cited

U.S. PATENT DOCUMENTS 2,917,824 12/1959 Brauss ..... 30/34.1
3,242,570 3/1966 Tietjens ..... 30/221
3,869,790 3/1975 Ihasz ..... 30/90
3,911,572 10/1975 Czerner ..... 30/34.1
3,962,785 6/1976 Poel ..... 30/90

*Primary Examiner*—Jimmy C. Peters
*Attorney, Agent, or Firm*—Rolf E. Schneider

[57] ABSTRACT

A hair trimmer comprises a first cutter reciprocatory relative to a second cutter, the two cutters having parallel cutting edges provided with teeth; a resilient element urging the two cutters towards one another; and a coupling member coupled to the first cutter. The resilient element includes a central portion acting on the second cutter and adjoined by two resilient limbs extending from the central portion through an opening in the first cutter and then away from one another in opposite directions corresponding to the directions of the reciprocatory movement of the first cutter, the distal ends of the resilient limbs exerting pressure on the first cutter and bearing against the coupling member.

4 Claims, 3 Drawing Figures

HAIR TRIMMER

This invention relates to a hair trimmer comprising a first cutter and a second cutter having parallel cutting edges with teeth, at least one of the cutters being reciprocatory and the two cutters being urged towards one another by a resilient element.

Such a hair trimmer is described in, for example, U.S. Pat. No. 2,917,824. This known trimmer employs a resilient element comprising two limbs which extend in directions perpendicular to the direction of movement of the driven cutter. Since the resilient element embraces the two cutters a comparatively intricate construction of this element is unavoidable and the resilient element must be of strong construction in order to urge the two cutters towards one another with adequate force. The ends of the limbs follow the movement of the driven cutter. This gives rise to substantial fluctuations in the force required for driving this cutter.

The present invention aims at mitigating the aforementioned drawbacks and is characterized in that the resilient element comprises a central portion which acts on the second cutter and which is adjoined by two resilient limbs which extend from the central portion through an opening in the first cutter and then away from one another in opposite directions corresponding to the directions of the reciprocatory movement of the first cutter, the distal ends of the resilient limbs exerting pressure on the first cutter.

The invention will now be described in more detail with reference to the accompanying drawings, in which.

Figure 1:
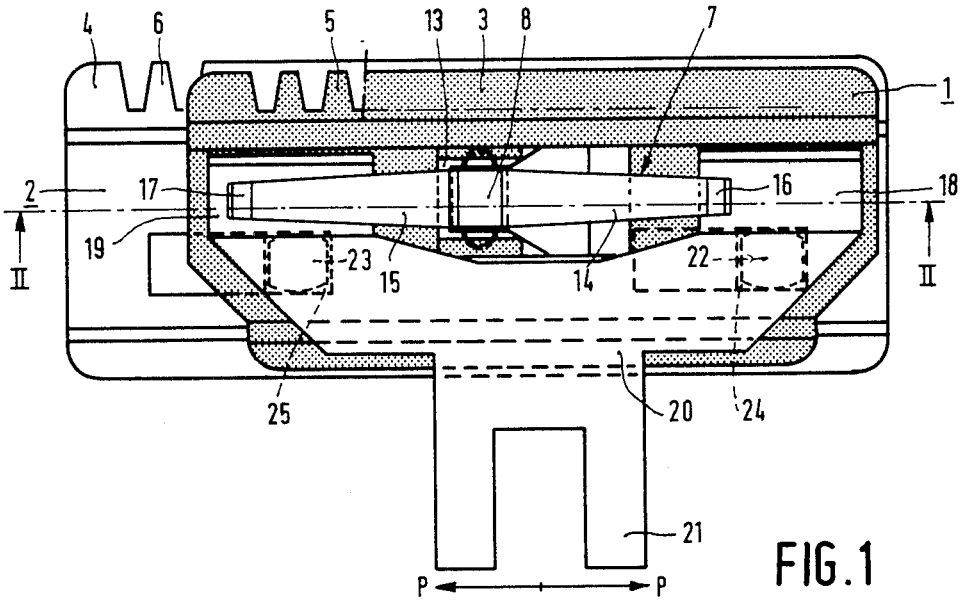
FIG. 1 is a plan view of a hair trimmer according to the invention.
Figure 2:
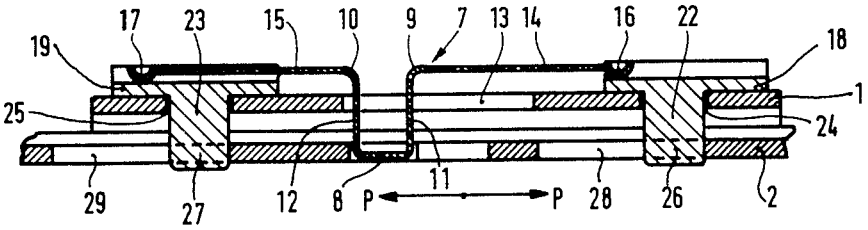
FIG. 2 is a longitudinal sectional view taken on the line II—II in FIG. 1.
Figure 3:
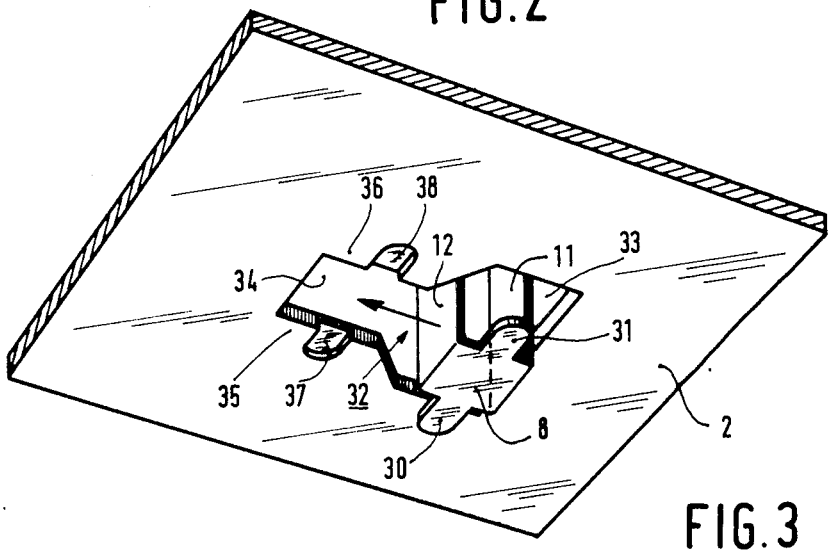
FIG. 3 is a perspective view of a part of the underside of the trimmer.

The trimmer shown in FIGS. 1, 2 and 3 comprises a first cutter 1 which is reciprocatory relative to a second cutter 2. The cutters 1 and 2 have parallel cutting edges 3 and 4, respectively, with teeth 5 and 6, respectively. The two cutters are urged towards one another by a resilient element 7 having a central portion 8 which acts on the cutter 2 and which is adjoined on opposite sides by two limbs 9 and 10. These limbs include portions 11 and 12 which extend from the central portion 8 perpendicularly to the plane of the first cutter through an opening 13 in the first cutter. The portions 11 and 12 are adjoined by portions 14 and 15 which extend away from one another in opposite directions corresponding to the directions of the reciprocatory movement of the cutter 1, as indicated by the arrows P. The distal ends 16 and 17 of the limbs 9 and 10 bear on the arms 18 and 19 of a bifurcate coupling member 20 by means of which the drivable cutter 1 can be driven. The coupling member 20 is formed with a fork 21 by means of which it can be coupled to a drive mechanism, known per se.

In the assembled condition the resilient element 7 is deflected elastically so that the ends 16 and 17 of the portions 14 and 15 exert pressure on the first cutter 1 via the coupling member 20, which pressure is directed towards the second cutter 2. This enables the resilient element 7 to be arranged very close to the cutting edges 3 and 4 of the cutters, so that the pressure exerted by the resilient element is utilized effectively.

The coupling member comprises projections 22 and 23 which fit in corresponding openings 24 and 25 in the first cutter 1 to transmit drive to this cutter.

The ends 26 and 27 of the projections 22 and 23 engage slidably in elongate openings 28 and 29 in the second cutter 2 to guide the coupling member 20 and with it the cutter 1, the elongate openings extending in the desired directions of movement P of the cutter 1, relative to the cutter 2.

The central portion 8 of the resilient element 7 includes two laterally projecting lugs or ears 30 and 31 for securing it to the second cutter 2. The second cutter 2 is formed with an opening 32 having a first part 33 through which the central portion 8 of the resilient element 7 including the lugs 30 and 31 can be passed in the assembly of the trimmer, and a narrower part 34 which extends from the part 33 and which is so dimensioned that when the central portion 8 of the resilient element is moved into this part the lugs 30 and 31 can hook behind portions 35 and 36 of the second cutter 2 which bound the part 34 of the opening 32.

As a result of this the trimmer can be assembled very simply. When the cutters 1 and 2 and the coupling member 20 have been placed on one another, the central portion 8 of the resilient element 7 is passed through the opening 13 in the cutter 1 and the part 33 of the opening 32 in the cutter 2 against the action of the elastic limbs 9 and 10 until the central portion 8 has passed slightly beyond the cutter 2. This situation is illustrated in FIG. 3. The resilient element 7 can now be moved sideways until the portions 11 and 12 of the elastic limbs 9 and 10 are situated in the part 34 of the opening 32. The resilient element 7 is now released and will resile until the lugs 30 and 31 bear against the portions 35 and 36 of the cutter 2 which bound the opening 34. These portions 35 and 36 have recesses 37 and 38 for receiving the lugs 30 and 31 to lock them against lateral displacement and also ensure that portions of the resilient element do not project from the cutter 2.

The two cutters, the coupling member and the resilient element constitute a force-coupled assembly which can be employed as a unit in, for example, a dry-shaver.

In the present embodiment the resilient element is a blade spring. However, other constructions such as those using a resilient wire material may alternatively be used.

Preferably, the coupling member 20 is made of a plastic. In this way friction forces between the ends 16 and 17 of the resilient element 7 and the coupling member 20 can be minimized.

What is claimed is:

1. A hair trimmer comprising a first cutter reciprocated relative to a second cutter, the two cutters having parallel cutting edges provided with teeth; a resilient element urging the two cutters towards one another; and a coupling member coupled to the first cutter; the resilient element including a central portion acting on the second cutter and adjoined by two resilient limbs extending from the central portion through an opening in the first cutter and then away from one another in opposite directions corresponding to the directions of the reciprocatory movement of the first cutter, the distal ends of the resilient limbs exerting pressure on the first cutter and bearing against the coupling member.

2. A hair trimmer according to claim 1, in which the coupling member includes projections engaging in corresponding openings in the first cutter to transmit drive to such cutter, the ends of the projections engaging slidably in elongate openings in the second cutter to guide the first cutter, said elongate openings extending in the desired directions of reciprocatory movement of the first cutter.

3. A hair trimmer according to claim 1, in which the central portion of the resilient element is provided with laterally projecting lugs for hooking behind the second cutter.

4. A hair trimmer according to claim 3, in which the second cutter is formed with an opening having a first part for passage of the central portion of the resilient element including said lugs in the assembly of the trimmer and a second part extending from said first part, the lugs of the central portion of the resilient element being arranged to hook behind portions of the second cutter bounding the second part of the opening.

* * * * *